US005917397A

United States Patent [19]

Sasahara

[11] Patent Number: 5,917,397

[45] Date of Patent: Jun. 29, 1999

[54] TRANSFORMER AND METHOD OF ASSEMBLING SAME

[75] Inventor: Yasumasa Sasahara, Hamamatsu, Japan

[73] Assignee: Yamaha Corporation, Hamamatsu, Japan

[21] Appl. No.: 08/887,823

[22] Filed: Jul. 3, 1997

[30] Foreign Application Priority Data

Jul. 15, 1996 [JP] Japan ..... 8-185074

[51] Int. Cl.[6] ..... H01F 27/30

[52] U.S. Cl. ..... 336/206; 336/208; 336/198

[58] Field of Search ..... 336/192, 182, 336/198, 208, 206, 183

[56] References Cited

U.S. PATENT DOCUMENTS 3,946,350 3/1976 Goto ..... 336/209
4,639,706 1/1987 Shimizu ..... 336/198

FOREIGN PATENT DOCUMENTS 4-42514 2/1992 Japan ..... 336/206

*Primary Examiner*—Michael L. Gellner
*Assistant Examiner*—Anh Mai
*Attorney, Agent, or Firm*—Loeb & Loeb LLP

[57] ABSTRACT

A transformer has a bobbin having a winding surface formed at a periphery thereof. Provided on the winding surface of the bobbin are at least one primary winding layer formed by a conductor wound around the winding surface of the bobbin, at least one secondary winding layer formed by a conductor wound around the winding surface of the bobbin, and at least one insulating layer each arranged between an associated one of the at least one primary winding layer and an associated one of the at least one secondary winding layer, for insulating them from each other. The at least one insulating layer is bent at an associated one of the at least one end portion of the bobbin and extends from the winding surface of the bobbin to a portion of the bobbin other than the winding surface.

14 Claims, 6 Drawing Sheets

TRANSFORMER AND METHOD OF ASSEMBLING SAME

BACKGROUND OF THE INVENTION

1. Field of the Invention

This invention relates to a transformer, and a method of assembling the same.

2. Prior Art

FIG. 1 shows a typical construction of a conventional transformer. In the figure, reference numeral 10 designates a bobbin which has a generally cylindrical shape and is made of plastics. The bobbin 10 has opposite ends thereof formed integrally with flanges 12 and a winding surface or outer peripheral surface 14 extending between the flanges 12, on which are wound winding layers. Specifically, a primary winding layer 16, a secondary winding layer 18, a secondary winding layer 20, a primary winding layer 22, and a secondary winding layer 24 are wound on the outer peripheral surface 14 in a fashion being superposed one upon another in the order mentioned from an inner side toward an outer side of the bobbin 10. The numbers of the primary and secondary winding layers are determined according to performance required of the transformer.

Interposed between the respective adjacent winding layers 16, 18, 20, 22, and 24 are interlayer tape layers 26, 28, 30 and 32 which are formed of adhesive tapes of an insulating material such as polyester to insulate the respective adjacent winding layers from each other. An outer peripheral tape layer 34 formed of a similar adhesive tape is applied on the outermost winding layer 24. In actuality, the tape layers 26 to 32 are wound on the respective inner winding layers in a plurality of turns dependent upon the required insulation performance and the safety standards.

Further, barrier tape layers 36, 38, 40 and 42 are provided at opposite sides of the respective winding layers 16, 18, 20 and 22. These barrier tape layers 36 to 42 are formed of adhesive tapes, e.g. of an insulating material such as a polyester tape and a non-woven composite tape of polyester impregnated with an epoxy resin.

The barrier tape layers serve to secure large required creeping distances between the respective adjacent winding layers 16, 18, 20 and 22. For example, by virtue of the presence of the barrier tape layers 36 and 38, the mutually adjacent winding layers 16 and 18 are spaced from each other along the interlayer tape layer 26 by a creeping distance corresponding to twice the widths of the barrier tapes, whereby it can be prevented that the winding layers 16 and 18 are shortcircuited to each other due to movement of a charge along the surfaces of the interlayer tape layer 26. Particularly, the barrier tape layers contribute to enhancement of the withstand voltage between a primary winding and a secondary winding such as the primary winding layer 16 and the secondary winding layer 18.

Requirements as to the creeping distance and the withstand voltage are prescribed by safety standards in various countries of the world to maintain the safety, etc. For example, in Japan, they are prescribed by Electrical Appliance And Material Law, Annexed List, Item C, in the United States, UL (Underwriters Laboratories Inc.)-1950, etc., and in Europe, IEC-EN60950, etc. Further, the numbers of turns in which tapes forming the barrier tape layers are to be wound are prescribed by the safety standards.

The conventional transformer with the barrier tape layers incorporated therein as above, however, is inevitably large in size. More specifically, the barrier tape layers 36 to 42 have substantial widths, which necessitates designing the bobbin 10 large in axial size. Besides, the barrier tape layers 36 to 52 are provided at the opposite sides of the respective winding layers 16 to 22 to positively prevent leakage of charge, and therefore the bobbin 10 has to have an axial size corresponding to twice the widths of the barrier tape layers 36 to 42.

In other words, the conventional transformer has a size larger than a size inherently required for the voltage transformation performance of the transformer. This makes it difficult to meet demands for development of information, communication, and broadcasting receiver apparatuses which are more compact in size.

Moreover, the safety standards vary between countries of the world. For example, according to UL-1950, the prescribed creeping distance is 3.2 mm or more, whereas, according to IEC-EN60950, it is 6.4 mm or more. Therefore, transformer manufacturers could not but take the following measures to cope with such differing standards.

(I) Design transformers according to the safety standards of each country and manufacture the thus designed transformers. This measure, however, entails increased manufacturing costs.

(II) Design all transformers according to the severest safety standards and manufacture the thus designed transformers. This measures, however, does not lead to final solution of the problem of large-sized transformers.

On the other hand, to solve the above problem, it has been proposed to coat a conductor forming the winding layer with a material having a high degree of insulation. This proposed method has the advantage that even if the creeping distance between the adjacent winding layers is made smaller, the withstand voltage does not decrease. To secure sufficient withstand voltage, however, the coating material having a high degree of insulation has to be coated on the conductor in a plurality of layers, or a single layer of the coating material which has an increased thickness has to be coated on the conductor. This results in an increased outer diameter of the entire conductor coated with the coating material, thus not substantially contributing to reduction of the size of the transformer. Besides, such a conductor coated with a material of a high degree of insulation is expensive. In addition, the coating material at ends of the conductor has to be removed in order to connect the conductor to terminals of the transformer, which is troublesome in assembling the transformer.

SUMMARY OF THE INVENTION

It is a first object of the invention to provide a transformer which can be designed compact in size as well as can have increased withstand voltage between adjacent primary and secondary winding layers.

It is a second object of the invention to provide a method of assembling the transformer under the first object in a simple and easy manner.

To attain the first object, the present invention provides a transformer comprising a bobbin having a winding surface formed at a periphery thereof, the bobbin having at least one end portion, at least one primary winding layer formed by a conductor wound around the winding surface of the bobbin, at least one secondary winding layer formed by a conductor wound around the winding surface of the bobbin,and at least one insulating layer each arranged between an associated one of the at least one primary winding layer and an associated one of the at least one secondary winding layer, for insulating them from each other, the at least one insulating layer being bent at an associated one of the at least one end portion of the bobbin and extending from the winding surface of the bobbin to a portion of the bobbin other than the winding surface.

With the above construction, since the at least one insulating layer is bent at an associated one of the at least one end portion of the bobbin and extends from the winding surface of the bobbin to a portion of the bobbin other than the winding surface, the insulating layer extends over a prolonged distance even when the bobbin is compact in size. That is, the insulating layer extends over a longer distance than the primary winding layer and the secondary winding layer to thereby secure a sufficient creeping distance between the primary winding layer and the secondary winding layer. Further, insofar as a bobbin of the same size is employed, the number of turns of the windings can be increased to thereby increase the capacity of the transformer.

In a preferred embodiment of the invention, the bobbin has at least one flange formed on the at least one end portion of the bobbin and extending radially outward of the bobbin, the at least one flange having at least one surface, the at least one insulating layer having a portion thereof extending along the at least one surface of the at least one flange.

With the above construction, the insulating layer is bent such that a portion of the layer extends along the surface of the flange radially outward of the bobbin. As a result, in a transformer of the type that cores are inserted in the bobbin, compared with a construction that the insulating layer is bent radially inward of the bobbin, the insertion area of the cores in the bobbin can be made large without designing the bobbin large in size. Further, the presence of the at least one flange facilitates the winding operation.

More preferably, two flanges are provided at opposite ends of the bobbin in a fashion radially outwardly extending from the winding surface, and the insulating layer has opposite end portions bent such that portions of the end portions extend along the surfaces of the two flanges.

Further preferably, the at least one surface of the at least one flange includes a radial surface extending from the winding surface radially outward of the bobbin, the portion of the at least one insulating layer extending along the radial surface.

Alternatively, the at least one surface of the at least one flange includes a radial surface extending from the winding surface radially outward of the bobbin, and an outer peripheral surface continuous from the radial surface, the portion of the at least one insulating layer extending along the radial surface and the outer peripheral surface.

Preferably, the at least one insulating layer is formed of an insulating adhesive tape.

More preferably, the insulating adhesive tape comprises an annular sheet having an inner peripheral edge, and an outer peripheral edge, the annular sheet having a plurality of first slits formed in the inner peripheral edge, and a second slit formed therein and extending between the inner peripheral edge and the outer peripheral edge.

Also preferably, the at least one insulating layer comprises an interlayer tape layer wound around the winding surface of the bobbin, and a bent tape layer extending along the at least one surface of the at least one flange, the interlayer tape layer and the bent tape layer being formed in separate bodies from each other.

Alternatively, the at least one insulating layer comprises a molded insulating material having a predetermined three-dimensional shape.

The employment of the the molded insulating layer having a three-dimensional shape further facilitates arranging the insulating layer around the bobbin formed with at least one flange, compared with the use of a flat adhesive sheet.

Preferably, the molded insulating material comprises a plurality of insulating pieces which are detachable from each other.

In assembling the the insulating layer, the insulating pieces can be easily placed around the bobbin and engaged with each other there, thus facilitating the assemblage of the transformer.

More preferably, the molded insulating material has hinge means provided on the plurality of insulating pieces and coupling the insulating pieces together such that the at least one insulating layer is foldable at the hinge means.

The provision of the hinge means can dispense with the need of consideration as to which insulating piece each insulating piece should be coupled with, etc.

Preferably, the hinge means is formed integrally on the plurality of insulating pieces.

To attain the second object, the present invention provides a method of assembling a transformer, comprising the steps of forming one of a primary winding layer and a secondary winding layer around a bobbin by winding a conductor around a winding surface of the bobbin formed at a periphery thereof, forming an insulating layer around the bobbin by placing a plurality of insulating pieces being detachable from each other, around the bobbin, the plurality of insulating pieces forming a molded insulating material having a predetermined three-dimensional shape, and engaging the plurality of insulating pieces with each other, and forming the other of the primary winding layer and the secondary winding layer by winding a conductor around the insulating layer.

According to this method, immediately upon completion of assemblage of the insulating layer by engaging the insulating pieces with each other, the insulating layer is arranged around the bobbin, to thereby facilitate the assemblage of the transformer.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
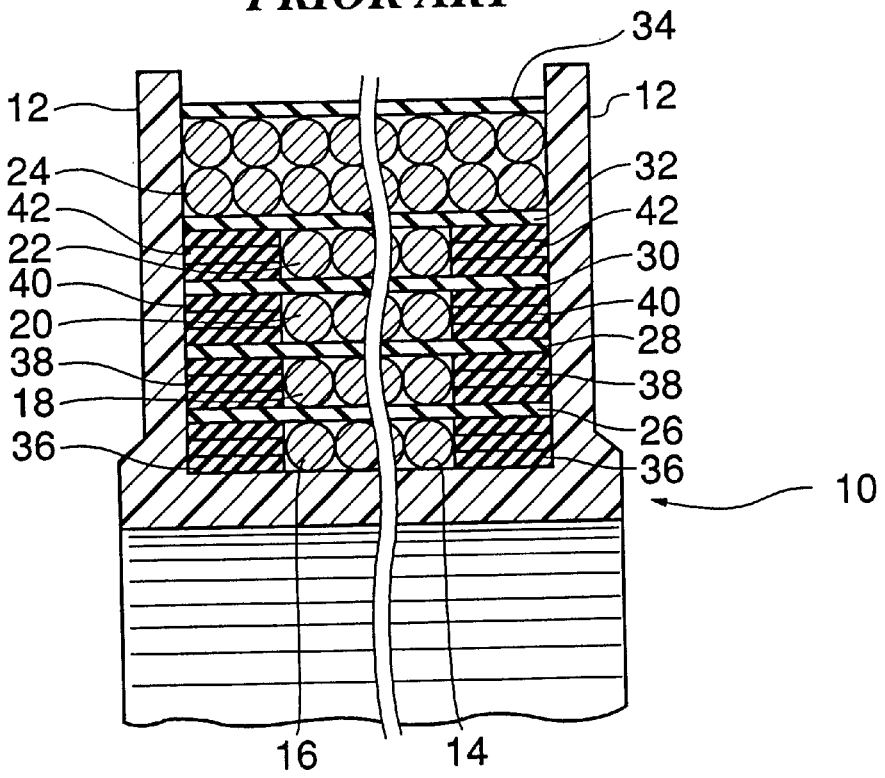
FIG.1 PRIOR ART
FIG. 1 is a sectional view showing a typical construction of a conventional transformer.
Figure 2:
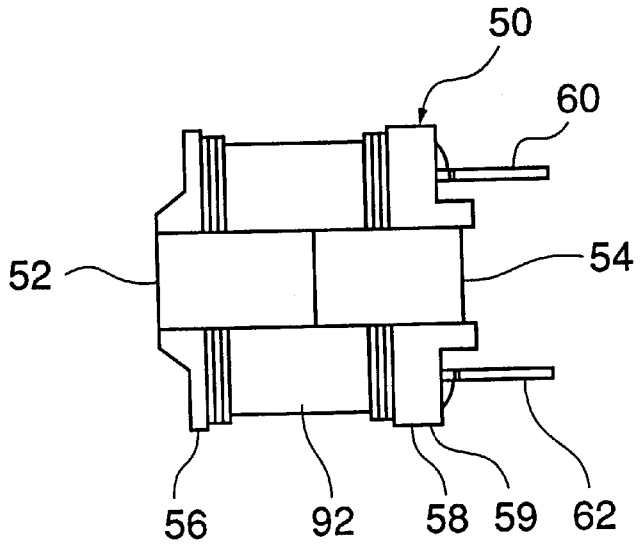
FIG. 2 is a front view showing a transformer according to a first embodiment of the invention.

Referring first to FIG. 2, there is illustrated the appearance of a transformer according to a first embodiment of the invention. In the figure, reference numeral 50 designates a bobbin, 52 and 54 a pair of cores. The bobbin 50 has its axis extending horizontally as viewed in the figure.

The bobbin 50 is cylindrical in shape and formed of plastics, with its opposite axial ends formed integrally with a pair of annular flanges 56 and 58. The flanges 56 and 58 may be fabricated in separate bodies from the bobbin 50 and subsequently attached to the latter. Further, only one flange may be provided on one of the opposite axial ends of the bobbin 50.

The flange 58 is formed integrally with a pedestal portion 59 carrying a plurality of terminal pins 60 and a plurality of terminal pins 62 projected axially from the pedestal portion 59 in a rightward direction as viewed in the figure. Ends of primary windings are joined to the terminal pins 60, while ends of a secondary winding are joined to the terminal pins 62.

Figure 3:
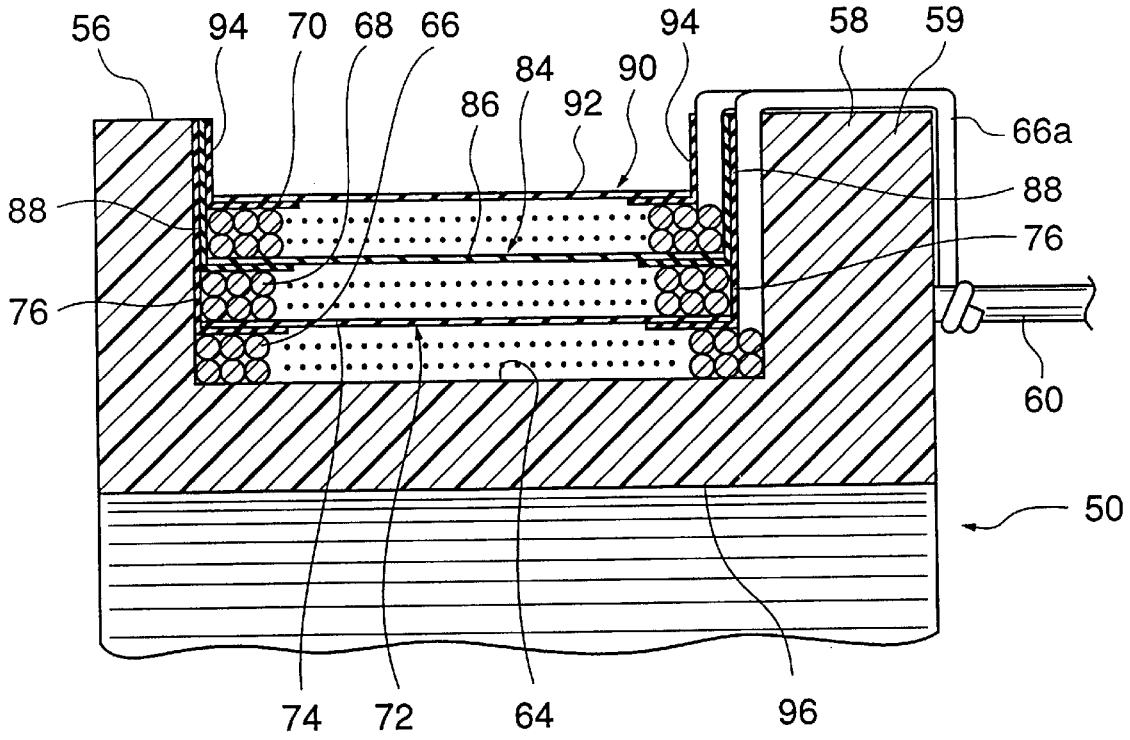
FIG. 3 is a sectional view showing, on an enlarged scale, the construction of the transformer of FIG. 2.

FIG. 3 shows, on an enlarged scale, the construction of the transformer. The cores 52 and 54 are omitted from the figure. As shown in the figure, the bobbin 50 has an outer peripheral surface (winding surface) 64 extending between the flanges 56 and 58, on which are wound a primary winding layer 66, a secondary winding layer 68, and a primary winding layer 70 in a fashion being superposed one upon another in the order mentioned from an inner side toward an outer side of the bobbin 50. The numbers of the primary winding layer and the secondary winding layer, and the numbers of turns of them are determined according to performance required of the transformer.

The primary winding layer 66 is formed by a conductor directly wound on the outer peripheral surface 64, with ends 66*a* thereof being joined to corresponding ones of the terminal pins 60.

An insulating layer 72 is provided on the primary winding layer 66, which is comprised of an interlayer tape layer 74 and a pair of bent tape layers 76 disposed at opposite sides of the layer 74. The interlayer tape layer 74 and the bent tape layers 76 are each formed of an adhesive tape having elasticity.

Figure 4:
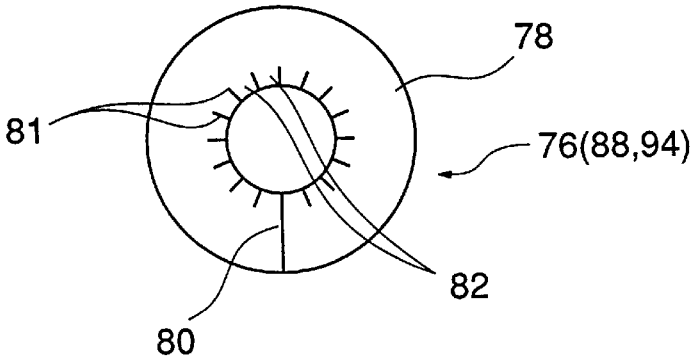
FIG. 4 is a front view showing an adhesive tape material for forming an insulating layer employed in the transform FIG. 2.

FIG. 4 shows an adhesive tape sheet 78 for forming the bent tape layers 76. The adhesive tape sheet 78 is in the form of a circular annular sheet. The sheet has formed therein a slit or cut 80 radially extending from a central opening or inner peripheral edge of the sheet 78 to an outer peripheral edge thereof, and a plurality of slits or cuts 81 radially extending from the central opening and terminating in a radially intermediate portion of the sheet 78.

To mount the adhesive tape layer sheet 78 on the transformer 50 to form the bent adhesive layer 76, the sheet 78 is stretched at a part thereof in the vicinity of the slit 80 by opening or pulling opposite side portions of the sheet defining the slit 80 to the left side and the right side respectively along the slit 80, and this stretched sheet 78 is placed around the primary winding layer 66 wound on the outer peripheral surface 64 of the bobbin 50, with its central opening fitted on the primary winding layer 66. Then, sections 82 of the sheet 78 shown in FIG. 4, which lie between respective adjacent ones of the slits 81 are urged against the primary winding layer 66 to cause them to become stuck thereto. Then, the other part or outer peripheral portion of the sheet 78 is applied over an inner side surface of an associated one of the flanges 56 and 58 and urged thereagainst to cause the same to become stuck to the associated one flange. In this manner, the bent tape layer 76 is formed. Thus, since the adhesive tape sheet 78 having elasticity is formed with the slits 81 and 82, the bent tape layer 76 which has a three-dimensional configuration can be obtained with ease, even from a flat sheet 78.

After the bent tape layers 76 are thus provided at the opposite sides of the primary winding layer 66, an ordinary adhesive tape in the form of a strip or a band is wound on and stuck to the primary winding layer 66 and part of the bent tape layers 76 to thereby form the interlayer tape layer 74. Thus, the insulating layer 72 is formed. To obtain a large creeping distance between the primary winding layer 66 and the secondary winding layer 68, the radial size of the sections 82 of the adhesive tape sheet 78 forming the bent tape layer 76 may be increased so that the interlayer tape layer 74 and the bent tape layer 76 overlap with each other over an increased axial length.

Thereafter, a conductor is wound on the interlayer tape layer 74 to form the secondary winding layer 68. Ends of the secondary winding layer 68 are joined to corresponding ones of the terminal pins 62 shown in FIG. 2, though not shown.

Then, an insulating layer 84 is formed over the secondary winding layer 68, which is comprised of an interlayer tape layer 86 and a pair of bent tape layers 88, similarly to the insulating layer 72. The bent tape layers 88 are similar to the bent tape layers 76, i.e. they are formed of an adhesive tape sheet identical with the adhesive tape sheet 78 shown in FIG. 4, only except for the radial size of the slits 81.

The sections 82 of the sheet 78 shown in FIG. 4, which lie between respective adjacent ones of the slits 81 are applied on and stuck to the secondary winding layer 68, while the other part or outer peripheral portion of the sheet 78 is applied on and stuck to an inner side surface of the bent tape layer 76 on an associated one of the flanges 56 and 58. Thus, the bent tape layers 88 are provided on opposite sides of the secondary winding layer 68, followed by winding an adhesive tape similar to the adhesive tape forming the interlayer tape layer 74, on the secondary winding layer 68 and part of the bent tape layers 88 to cause the former to become stuck to the latter, thus forming the insulating layer 84.

Thereafter, further, a conductor is wound on the interlayer tape layer 86 to thereby provide the primary winding layer 70. Ends of the primary winding layer 70 are joined to terminal pins 60, not shown, other than the terminal pins 60 to which are joined the ends 66*a* of the primary winding layer 66.

Then, further formed over the primary winding layer 70 is an insulating layer 90 which is comprised of an outermost tape layer 92 and a pair of bent tape layers at opposite sides of the layer 92. The bent tape layers 94 are also similar to the bent tape layers 76, i.e. they are also formed of an adhesive tape sheet identical with the adhesive tape sheet 78 shown in FIG. 4, only except for the radial size of the slits 81.

The sections 82 of the sheet 78 shown in FIG. 4, which lie between respective adjacent ones of the slits 81 are applied on and stuck to the primary winding layer 70, while the other part or outer peripheral portion of the sheet 78 is applied on and stuck to an inner side surface of the bent tape layer 88 on an associated one of the flanges 56 and 58. Thus, the bent tape layers 94 are provided on opposite sides of the primary winding layer 70, followed by winding an adhesive tape similar to the adhesive tape forming the interlayer tape layer 74, on the primary winding layer 70 and part of the bent tape layers 94 to cause the former to become stuck to the latter to provide the outermost tape layer 92, thus forming the insulating layer 90.

The bobbin 50 has an axial through hole 96 axially extending therethrough, in which the cores 52 and 54 appearing in FIG. 2 are partially inserted.

Figure 5:
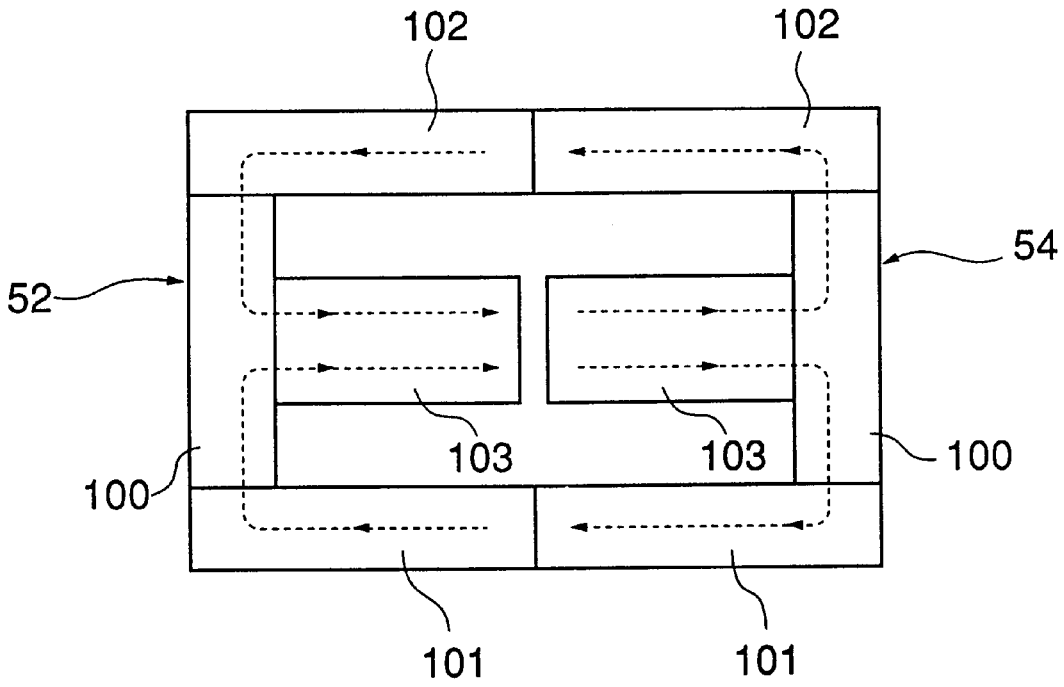
FIG. 5 is a front view showing cores employed in the transformer of FIG. 2.

FIG. 5 is a front view showing the cores 52 and 54. The cores 52 and 54 are each comprised of an end portion 100, a pair of lateral side portions 101 and 102, and a central portion 103. The lateral side portions 101 and 102 and the central portion 103 all extend in a projected fashion from the end portion 100 in the same direction.

When the cores 52 and 54 constructed as above are assembled on the transformer, the central portions 103 of the cores 52 and 54 are inserted into the axial through hole 96 of the bobbin 50 such that the lateral side portions 101 and 102 of the core 52 are brought into abutment with the lateral side portions 101 and 102 of the core 54, respectively. Then, the cores 52 and 54 are fixed in place by an adhesive tape, not shown. Thus, the transformer shown in FIG. 2 is completed. In this transformer, magnetic paths are formed as indicated by the arrows in FIG. 5.

Next, description will be made of the adhesive tapes employed to form the interlayer tape layers 74, 86, and outermost tape layer 92 and the bent tape layers 76, 88 and 94 of the insulating layers 72, 84 and 90.

Properties required of these adhesive tapes include insulation performance for prevention of a shortcircuit between the adjacent winding layers, and flame retardancy when heated. Further, flexibility is required of the adhesive tapes 76, 88 and 94.

The following adhesive tapes should desirably be used to meet the above requirements:

(I) A three-ply tape formed of an adhesive tape conventionally used as an interlayer tape. For example, a polyester tape which has a flame retardancy grade satisfying 510FR according to UL-1950 and has a thickness of 0.05 mm is used in triple plies.

(II) A single-ply tape formed of a polyester tape which has a flame-retardancy grade satisfying at least 94V−1 according to UL-1950 and has a thickness of 0.4 mm. The material of the tape is not limited to polyester, but elastomers or rubber may be employed.

The polyester tape under Paragraph (II) is particularly preferable for use as the bent tape layers 76, 88 and 94. This is because the adhesive tape material 78 for forming the bent tape layers 76, 88 and 94 is in the form of a flat annular disk as shown in FIG. 4 and therefore it is troublesome and costly to form a three-ply adhesive tape. On the other hand, the polyester tape under Paragraph (I) can be used for the interlayer tape layers 74 and 86, and the outermost tape layer 92 which are merely wound on their underlaid elements.

With the above described construction according to the present embodiment, in which the insulating layers 72 and 84 (bent tape layers 76 and 88) are disposed in a bent fashion with their outer peripheral portions laid over the inner side surfaces of the flanges 56 and 58, the insulating layers 72 and 84 extend over longer distances than the primary winding layers 66 and 70 and the secondary winding layer 68. As a result, sufficient creeping distances between the primary winding layers 66 and 70 and the secondary winding layer 68 can be secured.

Figure 6:
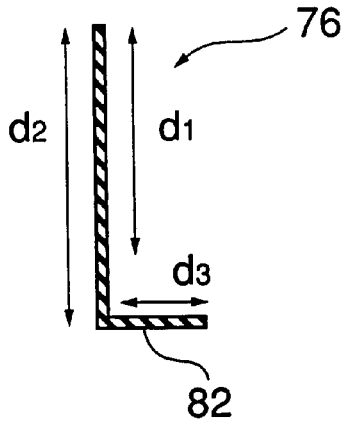
FIG. 6 is a sectional view showing a bent tape layer 76 on the left side in FIG. 3.

The relationship between the primary winding layer 66 and the secondary winding layer 68 will now be explained in detail with reference to FIG. 6 as well. The creeping distance between the primary winding layer 66 and the secondary winding layer 68 includes two kinds of creeping distances. One of them is twice the length of a vertical portion of the bent tape layer 76 stuck to the flange 56 or 58. More specifically, it is the sum d1+d2 of a length d1 of an area of contact between the vertical portion of the bent tape layer 76 and a vertical portion of the bent tape layer 88, and a length d2 of an area of contact between the vertical portion of the bent tape layer 76 and the flange 56 or 58. The other creeping distance is a length d3 of an area of overlaying between the interlayer tape layer 74 and the bent tape layer 76.

BY securing these two kinds of creeping distances, it can be prevented that a charge moves on the surfaces of the interlayer tape layer 74 or the bent tape layer 76 to cause the winding layers 66 and 68 to be shorted to each other. This also applies to the relationship between the secondary winding layer 68 and the primary winding layer 70.

Further, since the insulating layers 72 and 84 (bent tape layers 76 and 88) are disposed in a bent fashion such that part of them extend along the flanges 56 and 58, the bobbin 50 need not have a large axial length. As a result, the bobbin 50 can be designed compact in size while securing required withstand voltage and safety. In other words, the outer peripheral surface 64 can be more effectively utilized insofar as the bobbin 50 of the same size is employed. That is, the space for provision of the conventional barrier tape layers can be dispensed with, enabling employment of windings of increased numbers of turns and hence increasing the capacity of the transformer.

Moreover, by virtue of the presence of the flanges 56 and 58, the primary winding layers 66 and 70 and the secondary winding layer 68 can be formed by winding conductors on the bobbin with reference to the flanges 56 and 58, facilitating the assembling operation. Besides, by virtue of the bent disposition of the insulating layers 72 and 84 (bent tape layers 76 and 88) along the flanges 56 and 58, a sufficient space within the through hole 96 of the bobbin 50 into which the central portions 103 of the cores 52 and 54 are inserted can be secured without increasing the size of the bobbin 50. This is clear if it is assumed that the flanges 56 and 58 are not provided and the bent tape layers 76 and 88 are bent radially inward of the bobbin 50. Therefore, the formation of the flanges is particularly advantageous if the invention is applied to a transformer having cores.

Further, in the above described embodiment, the insulating layers 72 and 84 are each formed of two separate layers, i.e. the interlayer tape layer 74, 86 and the bent tape layer 76, 88 which is in a body separate from the former, the above-mentioned creeping distances can be selected as desired, e.g. by suitably selecting the outer diameter and inner diameter of the adhesive tape sheet 78 shown in FIG. 4 for forming the bent tape layers 76 and 88, the length of the slits 81, etc. Therefore, it is possible to fully meet requirements as to the number of turns of windings, working voltage, working current, safety standards, etc.

In the illustrated embodiment, the vertical portion of the bent tape layer 76 and the vertical portion of the bent tape layer 88 extending along the flange 56 or 58 has almost the same outer diameter as that of the flanges 56 and 58. This is not limitative. But, the former may be smaller than the latter, for example. Conversely, the bent tape layers 76 and 88 may be extended even over the outer peripheral surfaces of the flanges 56 and 58. This can be easily achieved by forming a plurality of slits in the outer peripheral edge of the adhesive tape sheet 78.

Figure 7:
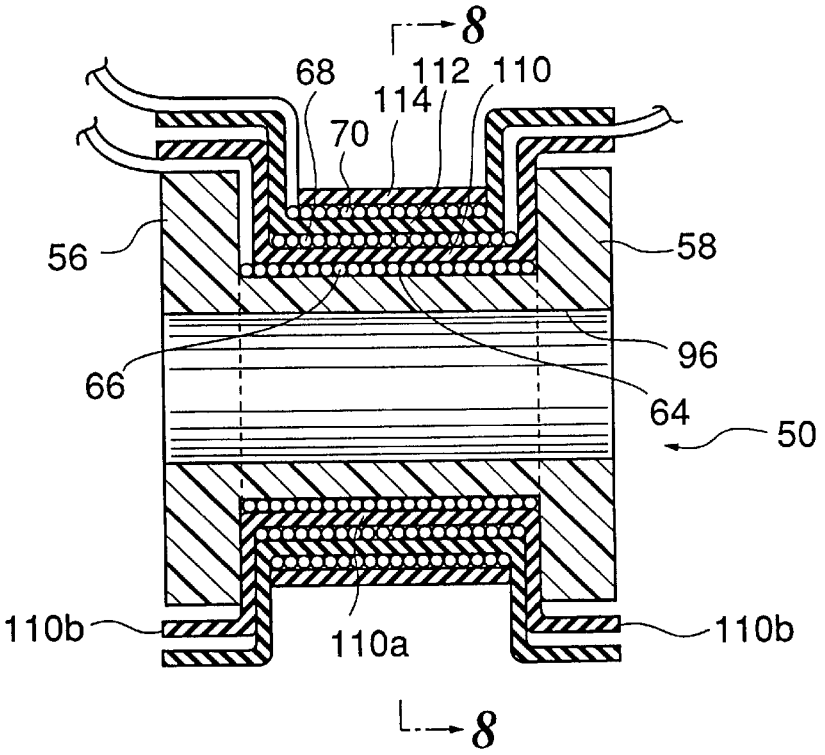
FIG. 7 is a sectional view showing the construction of a transformer according to a second embodiment of the invention.

FIG. 7 shows the construction of a transformer according to a second embodiment of the invention. Also in this figure, the cores 52 and 54 are omitted. In FIG. 7, corresponding elements to those in FIG. 3 are designated by identical reference numerals, description of which is omitted.

Also in the second embodiment, an insulating later 110 is provided between the primary winding layer 66 and the secondary winding layer 68, and an insulating layer 112 between the secondary winding layer 68 and the primary winding layer 70, and further an insulating layer 114 is provided on the primary winding layer 70.

These insulating layers 110 to 112 are each molded in a one-piece member beforehand, from an insulating material such as plastics, elastomers, or rubber. The insulating layers 110 and 112 each have a three-dimensional shape corresponding to the contour of the bobbin 50. That is, the insulating layer 110 is comprised of a winding cover portion 110*a* covering the primary winding layer 66, and a pair of flange cover portions 110*b* covering the flanges 56 and 58, respectively.

Compared with the use of a flat sheet-like adhesive tape material as in the first embodiment described above, the three-dimensional configuration of the insulating layers 110 and 112 facilitates mounting these insulating layers onto the bobbin 50. Advantageously, the insulating layers 110 to 114 may each be formed of a plurality of separate pieces which can be detached from each other, as described later. However, the insulating layer 114, which is merely wound on the primary winding layer 70, may be formed from an adhesive tape, similarly to the outermost tape layer 92 of the first embodiment.

Preferably, the insulating layers 110 to 114 may be formed of an insulating material satisfying a flame-retardancy grade of 94V–0 or more according to UL-1950, a withstand temperature of 150° C. or more, and a thickness of 0.4 mm.

Figure 8:
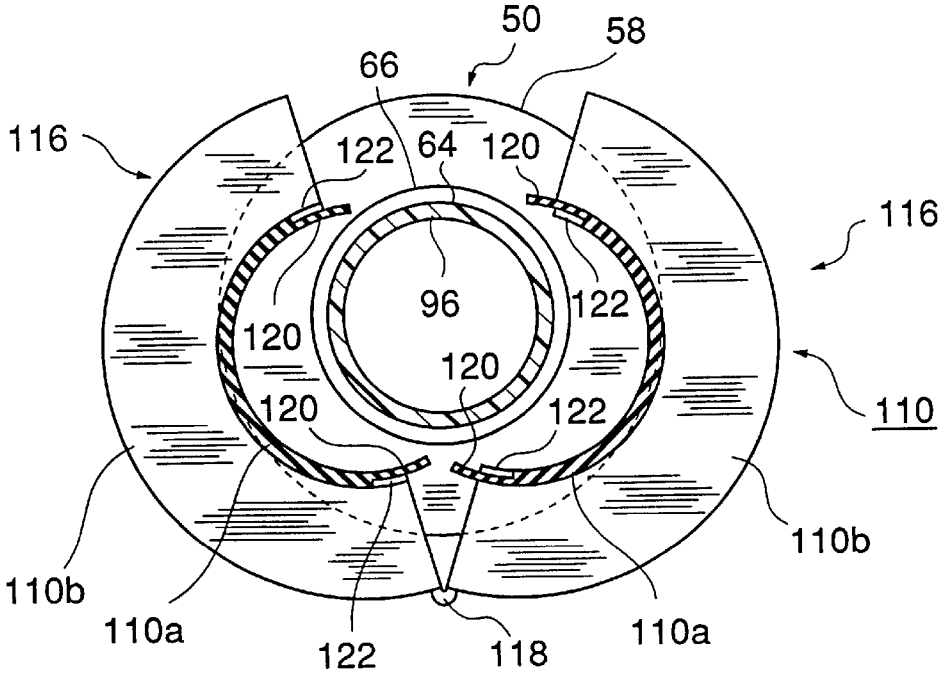
FIG. 8 is a sectional view taken along line 8—8 in FIG. 7, showing the transformer in a state just before an insulating layer is placed around a bobbin.
Figure 9:
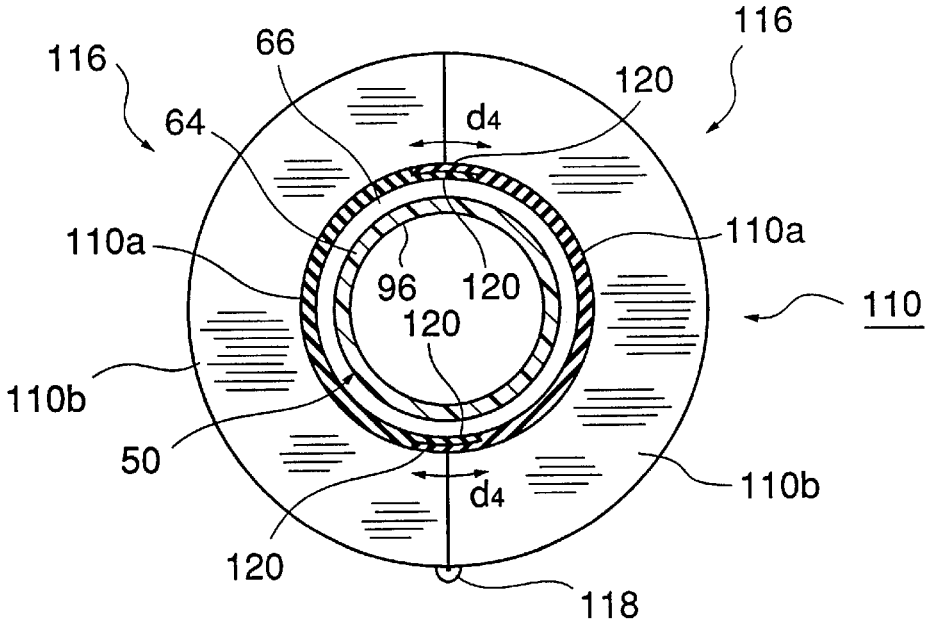
FIG. 9 is a sectional view taken along line 8—8 in FIG. 7, showing the transformer in a state after the insulating layer is placed around the bobbin.

FIGS. 8 and 9 show sectional views taken along line 8—8 in FIG. 7. FIG. 8 shows showing the transformer in a state just before the insulating layer 110 is mounted around the bobbin 50, and FIG. 9 shows the transformer in a state after the insulating layer 110 is mounted around the bobbin 50. The insulating 110 is comprised of a pair of insulating pieces 116. Each of the insulating pieces 116 has a shape obtained by cutting the insulating layer 110 into halves along a plane containing the axis thereof. The insulating layer 110 may be divided into a larger number of insulating pieces, if required.

A hinge 118 is formed integrally on the insulating pieces 116 at a junction thereof, along which the insulating layer 110 can be folded. The hinge 118 couples together flange cover portions 110*b* of the two insulating pieces 116. Only one such a hinge 118 may be provided, or a plurality of such hinges may be provided such that they are axially arranged on the insulating layer 110. Provision of the hinge 118 in any form can dispense with the need of consideration as to which insulating piece 116 each insulating piece should be coupled with, etc.

Each insulating piece 116 has a winding cover portion 110*a* which has opposite lateral edges thereof formed integrally with projections 120. Each projection 120 extends along an extension of the curvature of the winding cover portion 110*a* and has a thickness equal to half the thickness of the winding cover portion 110*a*. Each of the opposite lateral edges of the winding cover portion 110*a* also has a groove 122 at a region not formed with the projection 120. As shown in FIG. 8, the projections 120 of the two insulating pieces 116 are formed in a fashion being offset relative to each other. That is, the right upper projection 120 as viewed in FIG. 8 is located at a higher position than the left upper projection 120, while the left lower projection 120 is located at a higher position than the right lower projection 120.

To assemble the insulating layer 110 constructed as above, the two insulating pieces 116 are placed around the bobbin 50 and put together as shown in FIG. 9, by fitting the projections 120 into the grooves 122. The insulating layer 110 is thus assembled, whereupon it is mounted on the bobbin 50 which has a three-dimension configuration (and the primary winding layer 66 wound on the bobbin 50). Thus, the transformer can be assembled in a simple manner.

Also in the present embodiment, the insulating layers 110 and 112 are mounted on the bobbin 50 in a bent fashion with portions thereof being disposed along the flanges 56 and 58 of the bobbin 50. Therefore, the insulating layers 110 and 112 extend over longer distances than the primary winding layers 66 and 70 and the secondary winding layer 68, to thereby secure sufficient creeping distances between the primary winding layers 66 and 70 and the secondary winding layer 68, as shown in FIG. 7. Moreover, since the bent insulating layers 110 and 112 are disposed to extend along the flanges 56 and 58, the axial size of the bobbin 50 need not be increased, thereby making it possible to design the bobbin 50 compact in size while securing sufficient withstand voltage and safety. Further, the outer peripheral surface 64 can be more effectively utilized insofar as the bobbin 50 of the same size is employed.

As shown in FIG. 9, when the two insulating pieces 116 are put together, the length d4 of an area of contact between the projections 120 of the two insulating pieces 116 forms a creeping distance at this area. That is, the projections 120 and the grooves 122 do not only positively engage the two insulating pieces 116 with each other but also contribute to increasing the creeping distance between the winding layers.

Next, a manner of assembling the transformer according to the present embodiment will be described. First, a conductor is directly wound on the outer peripheral surface 64 of the bobbin 50 to form the primary winding layer 66. Then, the two insulating pieces 116 are put together to assemble the insulating layer 110 such that the insulating layer 110 is mounted on the bobbin 50 (and the primary winding layer 66) upon completion of the assemblage thereof, as described above.

Then, a conductor is wound on the outer peripheral surface of the winding cover portion 110*a* of the insulating layer 110 to form the secondary winding layer 68. Then, the insulating layer 112 is assembled by putting together a plurality of insulating pieces such that the insulating layer 110 is mounted on the bobbin 50 (and the secondary winding layer 68) upon completion of the assemblage thereof, similarly to the insulating layer 110.

Thereafter, a conductor is wound on the outer peripheral surface of a portion of the insulating layer 112 which covers the the secondary winding layer 68 to form the primary winding layer 70. Then, the insulating layer 114 is formed. The insulating layer 114 may be formed by putting together a plurality of insulating pieces, similarly to the insulating layer 110, or may be formed by winding an adhesive tape on the outer peripheral surface of the insulating layer 70.

Then, the central portions 103 of the cores 52 and 54 shown in FIG. 5 are inserted into the axial through hole 96 of the bobbin 50 such that the lateral side portions 101 and 102 of the core 52 are brought into abutment with the lateral side portions 101 and 102 of the core 54, respectively. Then, the cores 52 and 54 are fixed in place by an adhesive tape, not shown. Thus, a transformer, which is similar in appearance to the transformer of FIG. 2, is assembled in a simple manner.

Figure 10:
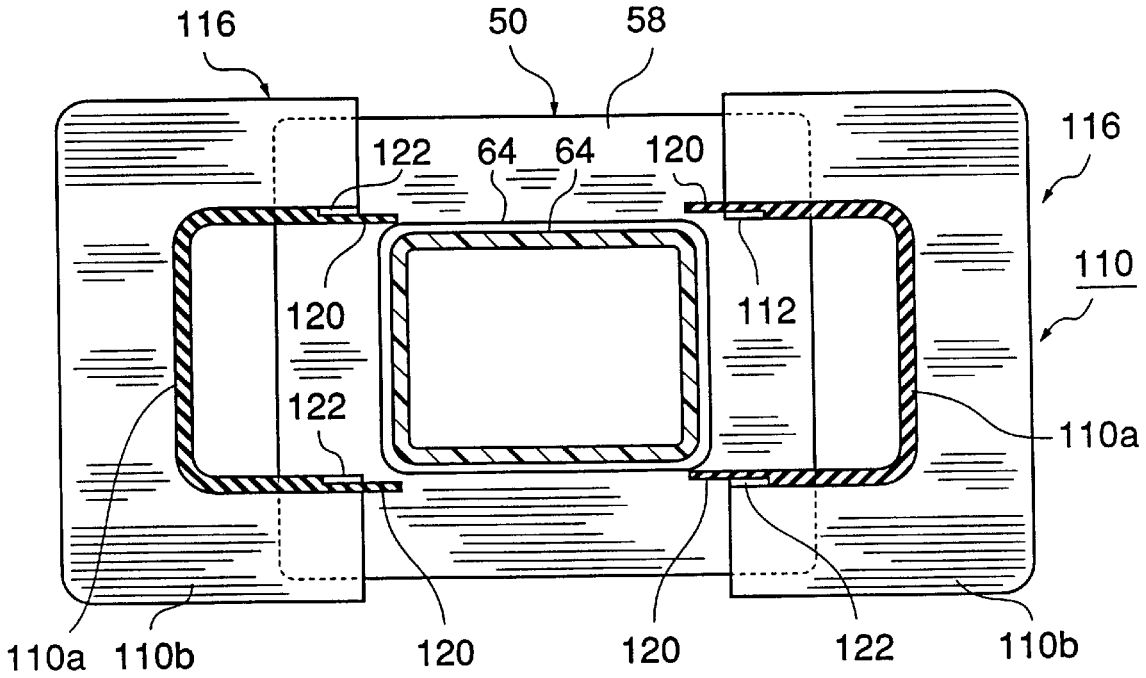
FIG. 10 is a similar sectional view to FIG. 8, showing a variation of the second embodiment.
Figure 11:
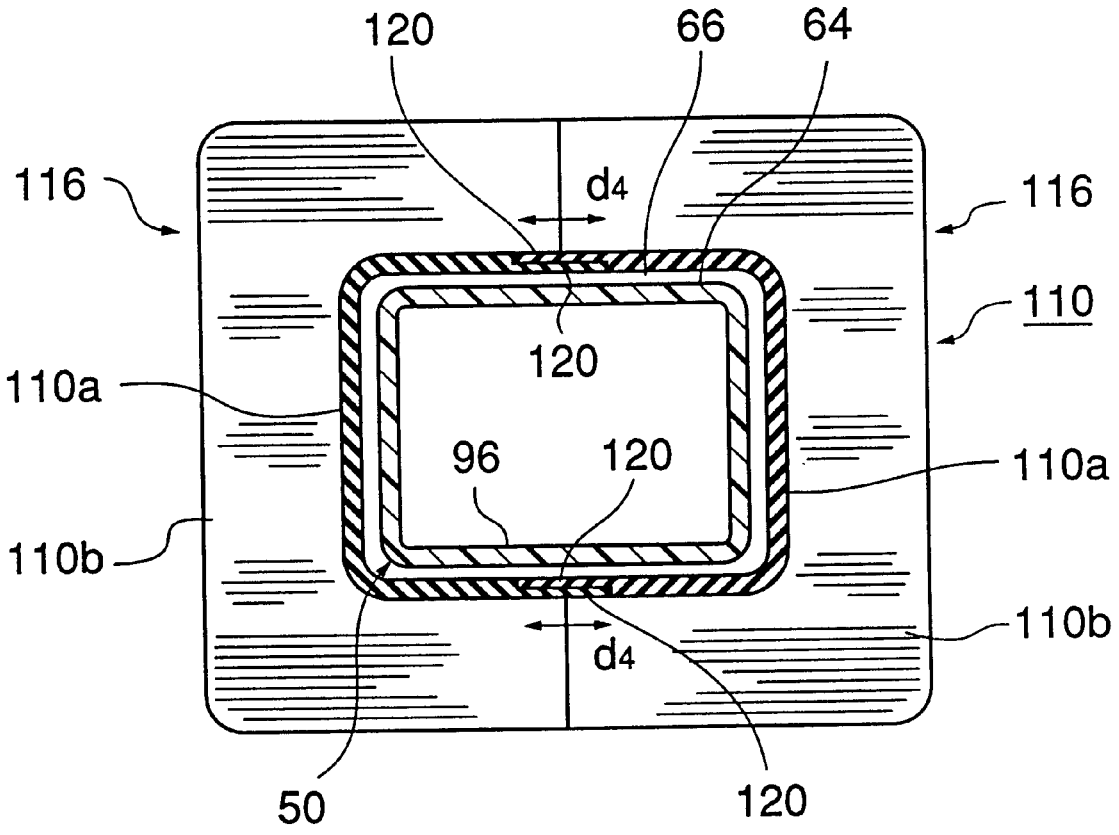
FIG. 11 is a similar sectional view to FIG. 9, showing a further variation of the second embodiment.

FIGS. 10 and 11 show a variation of the second embodiment described above. In these figures, elements corresponding to those in FIGS. 8 and 9 are designated by identical reference numerals, detailed description of which is omitted.

According to this variation, the hinge 118 at which the insulating layer 110 can be folded is not provided. Therefore, the two insulating pieces 116 can be completely separated from each other. This is advantageous in the case where the outer peripheral surface 64 of the bobbin 50 is not circular in section but substantially rectangular as illustrated in FIGS. 10 and 11 or has any other cross sectional shape. In the case where the outer peripheral surface 64 is not circular in section, if one tries to put together the insulating pieces 116 by opening and closing them along the hinge 118, there is a fear that the winding cover portions 110*a* (or projections 120 extending therefrom) of the insulating pieces 116 will collide against the outer peripheral surface 64, making it difficult to place the insulating layer 110 on the outer periphery of the bobbin 50 (and the primary winding layer 66).

Even if the outer peripheral surface 64 has any other cross sectional shape, however, the hinge 118 can be provided in some cases. That is, a case where the hinge 118 has high expansibility, and a case where the insulating pieces 116 or the projections 120 have high flexibility, though it depends upon the material of the insulating pieces 116.

What is claimed is:

1. A transformer comprising:

a bobbin having a winding surface formed at a periphery thereof, said bobbin having at least one flange formed on at least one end portion thereof and extending radially outward thereof, said at least one flange having at least one surface;

at least one primary winding layer formed by a conductor wound around said winding surface of said bobbin;

at least one secondary winding layer formed by a conductor wound around said winding surface of said bobbin;

at least one first insulating layer formed around said at least one primary winding layer; and at least one second insulating layer formed around said at least one secondary winding layer;

wherein said at least one first insulating layer comprises an interlayer insulating portion arranged around said at least one primary winding layer, and a bent insulating portion extending along said at least one surface of said at least one flange, and said at least one second insulating layer comprises an interlayer insulating portion arranged around said at least one secondary winding layer, and a bent insulating portion extending along said at least one surface of said at least one flange.

2. A transformer as claimed in claim 1, wherein said at least one surface of said at least one flange includes a radial surface extending from said winding surface radially outward of said bobbin, said bent insulating portion of said at least one first insulating layer and said bent insulating portion of said at least one second insulating layer extending along said radial surface.

3. A transformer as claimed in claim 2, wherein the bent insulation portion of at least one first insulating layer and the bent insulation portion of at least one second insulating layer extend outwardly along the radial surface of the at least one flange and at least partially overlap each other.

4. A transformer as claimed in claim 1, wherein said at least one surface of said at least one flange includes a radial surface extending from said winding surface radially outward of said bobbin, and an outer peripheral surface continuous from said radial surface, said bent insulating portion of said at least one first insulating layer and said bent insulating portion of said at least one second insulating layer extending along said radial surface and outer peripheral surface.

5. A transformer as claimed in claim 1, wherein said at least one first insulating layer and said at least one second insulating layer are formed of an insulating adhesive tape.

6. A transformer as claimed in claim 5, wherein said insulating adhesive tape comprises an annular sheet having an inner peripheral edge, and an outer peripheral edge, said annular sheet having a plurality of first slits formed in said inner peripheral edge, and a second slit formed therein and extending between said inner peripheral edge and said outer peripheral edge.

7. A transformer as claimed in claim 5, wherein said interlayer insulating portion and said bent insulating portion of each of said at least one first insulating layer and said at least one second insulating layer are formed in separate bodies from each other.

8. A transformer as claimed in claim 1, wherein said at least one first insulating layer and said at least one second insulating layer and said at least one second insulating layer each comprise a molded insulating material having a predetermined three-dimensional shape.

9. A transformer as claimed in claim 8, wherein said molded insulating material comprises a plurality of insulating pieces which are detachable from each other.

10. A transformer as claimed in claim 9, wherein said molded insulating material has hinge means provided on said plurality of insulating pieces and coupling said insulating pieces together such that said at least one insulating layer is foldable at said hinge means.

11. A transformer as claimed in claim 10, wherein said hinge means is formed integrally on said plurality of insulating pieces.

12. A transformer as claimed in claim 1, wherein the bent insulation portion of at least one first insulating layer at least partially overlaps the bent insulation portion of at least one second insulating layer.

13. A method of assembling a transformer, comprising the steps of:

preparing a bobbin having a winding surface formed at a periphery thereof, said bobbin having at least one flange formed on at least one end portion thereof and extending radially outward thereof, said at least one flange having at least one surface;

forming one of a primary winding layer and a secondary winding layer around said bobbin by winding a conductor around said winding surface of said bobbin;

preparing a plurality of first insulating pieces being detachable from each other, said plurality of first insulating pieces forming a first molded insulating material having a predetermined three-dimensional shape;

forming a first insulating layer around said one of said primary winding layer and said secondary winding layer by placing said plurality of first insulating pieces around said bobbin, and engaging said plurality of first insulating pieces with each other, said first insulating layer comprising an interlayer insulating portion arranged around said one of the primary winding layer and said secondary winding layer, and a bent insulating portion extending along said at least one surface of said at least one flange;

forming the other of said primary winding layer and said secondary winding layer by winding a conductor around said first insulating layer; and preparing a plurality of second insulating pieces being detachable from each other, said plurality of second insulating pieces forming a second molded insulating material having a predetermined three-dimensional shape; and forming a second insulating layer around the other of said primary winding layer and said secondary winding layer by placing said plurality of second insulating pieces around said bobbin, and engaging said plurality of second insulating pieces with each other, said second insulating layer comprising an interlayer insulating portion arranged around the other of said primary winding layer and said secondary winding layer, and a bent insulating portion extending along said at least one surface of said at least one flange.

14. A method of assembling a transformer as claimed in claim 13, wherein the bent insulation portion of the first insulating layer at least partially overlaps the bent insulation portion of the second insulating layer.

* * * * *